US005939016A

United States Patent [19]

Mathiesen et al.

[11] Patent Number: 5,939,016

[45] Date of Patent: Aug. 17, 1999

[54] APPARATUS AND METHOD FOR TAPPING A MOLTEN METAL BATH

[75] Inventors: Mihkel Mathiesen, Westport; Michael Gomes; Shaul Abramovich, both of Fall River, all of Mass.

[73] Assignee: Quantum Catalytics, L.L.C., Fall River, Mass.

[21] Appl. No.: 08/823,346

[22] Filed: Mar. 24, 1997

Related U.S. Application Data

[60] Provisional application No. 60/023,428, Aug. 22, 1996.

[51] Int. Cl.[6] ..... C21B 7/12

[52] U.S. Cl. ..... 266/45; 266/237; 222/593

[58] Field of Search ..... 266/44, 45, 237; 222/590, 591, 594, 593

[56] References Cited

U.S. PATENT DOCUMENTS

| | | | |
|---|---|---|---|
| 4,402,724 | 9/1983 | Weisenburger et al. | 65/128 |
| 4,574,714 | 3/1986 | Bach et al. | 110/346 |
| 4,602,574 | 7/1986 | Bach et al. | 110/346 |
| 5,055,433 | 10/1991 | Niwa et al. | 501/105 |
| 5,198,017 | 3/1993 | Mourer et al. | 75/345 |
| 5,214,010 | 5/1993 | Whittemore | 501/105 |
| 5,223,157 | 6/1993 | Brückner et al. | 222/599 |
| 5,301,620 | 4/1994 | Nagel et al. | 110/346 |
| 5,366,204 | 11/1994 | Gigliotti, Jr. et al. | 222/593 |
| 5,564,487 | 10/1996 | Cahill et al. | 164/151.3 |
| 5,588,019 | 12/1996 | Ruffini et al. | 373/152 |
| 5,765,730 | 6/1998 | Richter | 266/237 |

FOREIGN PATENT DOCUMENTS

| | | |
|---|---|---|
| 0234572A1 | 9/1987 | European Pat. Off. . |
| 0560494A1 | 9/1993 | European Pat. Off. . |
| 1527380 | 9/1968 | France . |
| 1758451 | 9/1976 | Germany . |
| 3446260-A1 | 7/1986 | Germany . |
| 3-199318 | 8/1991 | Japan . |
| 440859 | 2/1936 | United Kingdom . |
| 1159736 | 7/1969 | United Kingdom . |
| 1239710 | 7/1971 | United Kingdom . |
| WO 94/21406 | 9/1994 | WIPO . |
| WO 95/04621 | 2/1995 | WIPO . |
| WO 95/15827 | 6/1995 | WIPO . |
| WO 95/28363 | 10/1995 | WIPO . |
| WO 96/34711 | 11/1996 | WIPO . |

*Primary Examiner*—Scott Kastler
*Attorney, Agent, or Firm*—Hamilton, Brook, Smith & Reynolds, P.C.

[57] ABSTRACT

An apparatus and method relate to tapping a molten metal bath from a reactor. The apparatus includes a tapping pipe having a tapping pipe inlet and tapping pipe outlet for withdrawing a portion of the molten bath from the reactor. The molten bath can flow from the reactor through the tapping pipe inlet through tapping pipe to a tapping pipe exit. The tapping pipe is attached to the reactor at the tapping pipe inlet and the tapping pipe includes a susceptor, formed of a suitable material, such as graphite, which heats upon application of induction current. An induction coil assembly is annularly disposed about the tapping pipe, wherein the induction coil assembly can apply an induction current to heat the tapping pipe to a temperature that is higher than that of a solidified bath metal component within the tapping pipe. The induction current melts the solidified bath metal, whereby the molten metal bath can be tapped from the reactor. A slidable gate valve assembly can be attached at the tapping pipe outlet for further control of tapping.

51 Claims, 7 Drawing Sheets

APPARATUS AND METHOD FOR TAPPING A MOLTEN METAL BATH

RELATED APPLICATION

The present application claims priority to copending U.S. Provisional Patent Application Ser. No. 60/023,428, filed on Aug. 22, 1996, the teachings of which are herein incorporated by reference.

BACKGROUND OF THE INVENTION

Many metallurgical vessels have tap holes for removing a portion of a molten bath contained within the vessel. The tap holes often operate at a lower temperature than the molten bath in the vessel itself, even if the tap holes are preheated. As a result, the molten bath discharged through the tap holes can solidify, thereby preventing further discharge of the molten bath.

Tap holes can be opened for tapping, for example, by applying oxygen jets to heat or mechanical drilling or both to free up a previously blocked tap hole. However, controlling the tapping can be difficult and dangerous once the tap holes are open. Typically, flow only ceases once the level of the molten bath in the furnace reaches a point at or below the tap hole inlet. However, the amount of molten material removed in this manner is dependent on the location of the tap hole. Limiting the amount of melt removed in this manner can cause escape of noxious fumes from the reactor into the surrounding atmosphere.

Therefore, a need exists for a new apparatus and method for controlling tapping of a molten bath to eliminate or minimize the problems described above.

SUMMARY OF THE INVENTION

The present invention relates to an apparatus and method for tapping a molten metal bath from a reactor.

The apparatus includes a tapping pipe having a tapping pipe inlet and a tapping pipe outlet. The tapping pipe is attachable at the tapping pipe inlet to a reactor. The tapping pipe includes a susceptor, whereby the tapping pipe can be heated by an induction current to a temperature higher than that of a solidified bath metal component within the tapping pipe. An induction means is located at the tapping pipe, wherein the induction coil can apply an induction current to the susceptor to heat the tapping pipe to a temperature that is higher than that of the bath metal within the tapping pipe, and thereby melt the solidified bath metal to tap the molten metal bath from the reactor.

The tapping pipe is an integral component of a tapping assembly which includes a tubular shape of an electrically conducting susceptor material, such as graphite or graphite-refractory composites, such as alumina graphite, which can be inductively heated to temperatures of at least up to about 1,700° C. without losing mechanical integrity.

When the tapping pipe is used to tap materials which are not chemically aggressive to graphite, such as ceramic melts, the tapping pipe itself can be formed of graphite or a graphite-refractory composite material.

On the other hand, when the tapping pipe is used to tap materials which are aggressive to graphite, such as metals which are not saturated with carbon, and therefore tend to dissolve carbon from the graphite, the tapping pipe can be made from a material which is largely unaffected by the presence of the liquid metal, such as a ceramic material. The ceramic material can have a wall thickness of about 3 to 10 mm and should exhibit resistance to thermal shock at heating rates of at least up to 150° C. per minute, such as, for example, low porosity alumina silicon carbide composites with silicon carbide contents typically in the range of between about 5 and 30 weight percent. The tubular electrically conducting susceptor component of the tapping assembly is annularly disposed about the ceramic tapping pipe.

In one embodiment, a thermal insulator is annularly disposed about the tubular electrically conducting component of the tapping assembly.

A cooled induction coil assembly is typically protected by a thermally conducting refractory material and is annularly disposed about the thermal insulator, allowing the induction coil assembly to inductively heat the electrically conductive tubular component of the assembly, which either directly, or by conduction through the ceramic tapping pipe, heats the tapping conduit to melt solid material within the tapping conduit thereby allowing this molten material to flow out of the tapping pipe followed by desired portions of the bath within the reactor.

Between taps, the cooling capability of the induction coil assembly can be used to extract heat from the tapping conduit to maintain a maximum amount of the material contained in the tapping conduit in solid form to minimize erosion, corrosion and other unwanted effects caused by extended exposure of the tapping conduit to the melt within the reactor.

The thermal insulation can be chosen to minimize heat losses to the coil assembly cooling water when the induction coil is activated during tapping and to maximize the heat extraction when the coil assembly is not activated. For example, it has been found that fibrous ceramic insulating materials with thermal conductivities in the range of about 0.06 to 0.2 W/Mk at room temperature and about 0.2 to 0.5 W/Mk at 1,500° C. applied in thicknesses of about 5 to 30 mm around the electrically conducting tubular component, having outer diameters in the range of about 70 to 150 mm satisfy the requirement of maintaining an essentially solid plug in the tapping conduit between taps and the need to limit thermal losses when the tapping conduit is filled with molten material.

When a portion of the molten bath has been withdrawn from the reactor, the tapping assembly can be closed by mechanical means, for example by using a slide gate assembly, or by means of manipulating the pressure differential over the tapping conduit. When tapping melts which increase their viscosity with decreasing temperatures, such as molten ceramic phases, the flow can also be stopped by switching off power to the induction coil, allowing the coil coolant to cool the tapping conduit sufficiently to allow the molten bath within the tapping pipe to solidify, thereby controlling tapping of the molten bath.

The method includes applying an induction current to a susceptor of a tapping pipe, whereby said tapping pipe is heated by an induction current to a higher temperature than that of a solidified bath metal component within the tapping pipe, the solidified bath metal melting in the tapping pipe. At least a portion of the molten metal bath is then tapped from the reactor.

In one embodiment, the method includes applying induction heating to a tapping pipe formed of a material which heats upon application of an induction current and having a tapping pipe inlet and tapping pipe outlet for withdrawing a portion of the molten bath from the reactor through the tapping pipe by inducing an induction coil annularly disposed about the tapping pipe with sufficient energy to heat the tapping pipe and melt the metal within the tapping pipe. A portion of the molten bath is withdrawn from the reactor. The tapping pipe is cooled sufficiently to allow the molten bath within the tapping pipe to solidify, thereby controlling tapping of the molten bath.

This invention provides several advantages. One advantage is that the tapping apparatus provides good control over the level of the molten bath within the reactor. Another advantage is that the apparatus and method of the invention causes the tapping pipe to expand more rapidly than solidified metal within the tapping pipe, thereby significantly reducing the likelihood that the tapping pipe will be split or otherwise ruptured by expanding metal contained with the pipe.

DETAILED DESCRIPTION OF THE INVENTION

The features and other details of the apparatus and method of the invention will now be more particularly described with reference to the accompanying drawings and pointed out in the claims. The same numeral present in different figures represent the same item. It will be understood that the particular embodiments of the invention are shown by way of illustration and not as limitations of the invention. The principle features of this invention can be employed in various embodiments without departing from the scope of the invention. All parts and percentages are by weight unless otherwise specified.

The present invention relates generally to an apparatus and method for controlled tapping of a molten bath in a metal reactor. A process and apparatus for dissociating waste in molten baths are disclosed in U.S. Pat. Nos. 4,574,714 and 4,602,574, issued to Bach/Nagel. The method and apparatus described by these patents can destroy polychlorinated biphenyls and other organic wastes, optionally together with inorganic waste. Both U.S. Pat. Nos. 4,574,714 and 4,602,574 are hereby incorporated by reference in their entirety. Another apparatus and method for dissociating waste in a molten metal bath and for forming gaseous, vitreous and molten metal product streams from the waste are disclosed in U.S. Pat. No. 5,301,620, issued to Nagel et al., the teachings of which are hereby incorporated by reference in their entirety.

Figure 1:
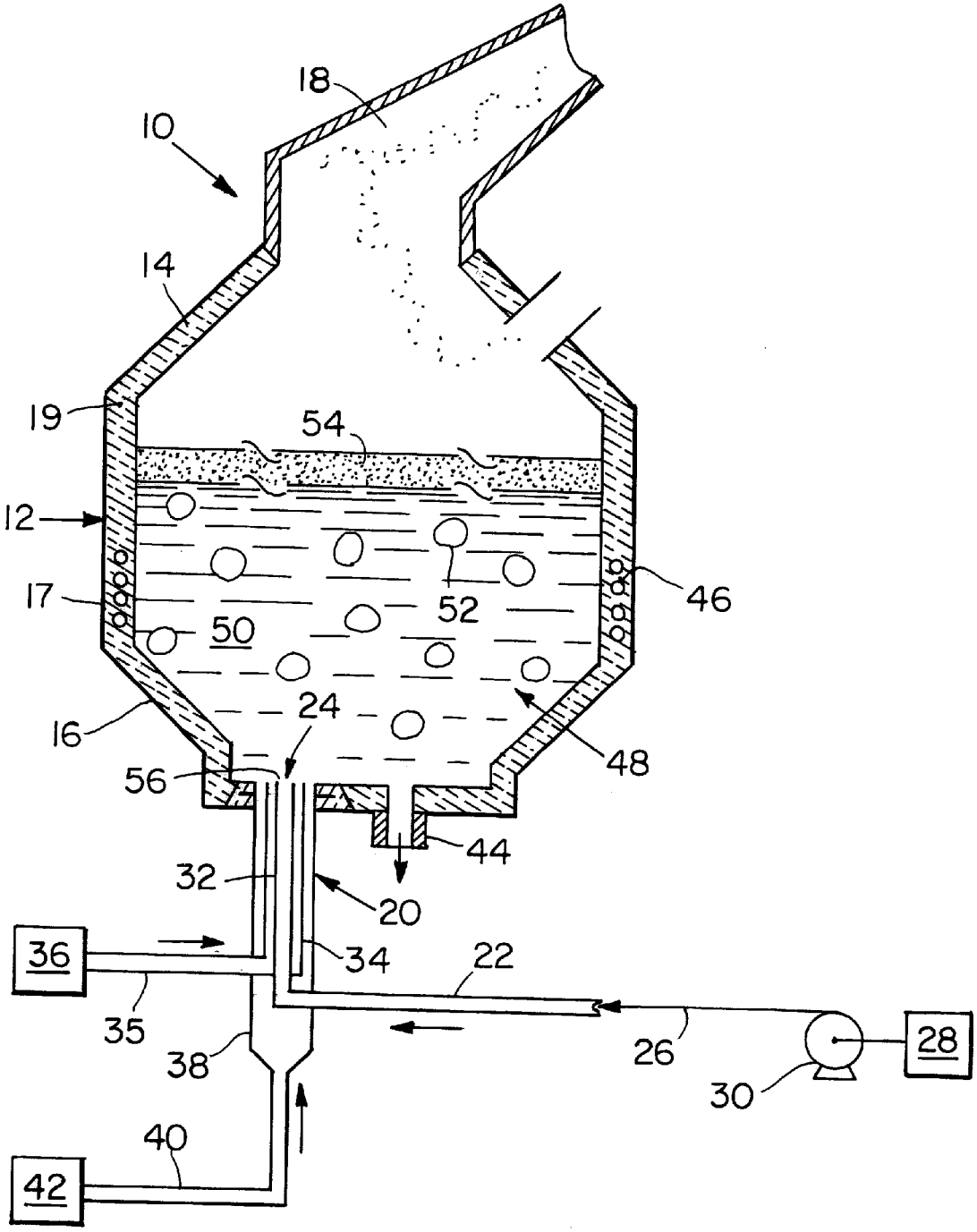
FIG. 1 is a cut-away side elevational view of one embodiment of the apparatus of the present invention attached to a reactor.

One embodiment of the invention is illustrated in FIG. 1. Therein, system 10 includes reactor 12 for containing a molten bath suitable for dissociating a feed material. Examples of suitable reactors include appropriately modified steelmaking vessels known in the art, such as K-BOP, Q-BOP, argon-oxygen decarbonization furnaces (AOD), BOF, etc. Reactor 12 includes upper portion 14 and lower portion 16. Off-gas outlet 18 extends from upper portion 14 and is suitable for conducting an off-gas composition out of reactor 12. Reactor 12 has metal shell 17 and is lined with refractory lining 19. Refractory lining 19 can be, for example, bricks composed of aluminum oxide ($Al_2O_3$), magnesium oxide (MgO), silicon dioxide ($SiO_2$), thorium dioxide ($ThO_2$), zirconium dioxide ($ZrO_2$), or other suitable materials, such as a ceramic. Refractory lining 19 can be coated with a gas permeable coating, such as sputtered aluminum oxide.

Tuyere 20 is located at lower portion 16 of reactor 12 and can be a multiple concentric tuyere, in particular, a triple concentric tuyere. Tuyere 20, which is a concentric tuyere, includes feed material tube line 22 for directing a feed material to feed material tube 32 for injection of the feed material at tuyere inlet 24. Line 26 extends between feed material tube line 22 and feed material source 28 for conducting feed material from feed material source 28 by pump 30 to feed material tube 22.

Oxidizing agent tube 34 of tuyere 20 is disposed concentrically around feed material tube 32 at tuyere inlet 24. Line 35 extends between oxidizing agent source 36 and oxidizing agent tube 34 for conducting a suitable oxidizing agent through oxidizing agent tube 34 to tuyere inlet 24. Oxidizing agent can be, for example, oxygen gas or some other gas which can oxidize a portion of the waste to form a dissociation product, such as carbon monoxide or carbon dioxide.

Shroud gas tube 38 of tuyere 20 is disposed concentrically around oxidizing agent tube 34 at tuyere inlet 24. Line 40 extends between shroud gas tube 38 and shroud gas source 42 for conducting a suitable shroud gas through shroud gas tube 38 to tuyere inlet 24. Shroud gas can be, for example, an inert gas, such as argon or nitrogen, or a hydrocarbon, such as propane.

Tapping assembly 44 extends from the bottom of lower portion 16 of reactor 12 and is suitable for removal of molten material, such as molten metal, from reactor 12. Alternatively, tapping assembly 44 can extend from the side of reactor 12. Induction coil 46 is located at lower portion 16 for heating molten metal bath 48 in reactor 12. It is to be understood, alternatively, that reactor 12 can be heated by other suitable means, such as by an oxyfuel burner, electric arc, etc.

Molten metal bath 48 can be formed within reactor 12. Molten metal bath 48 can include at least one metal or molten salt thereof. Examples of suitable metals include copper, iron, nickel, zinc, etc. Examples of suitable salts include potassium chloride, sodium chloride, etc. Molten bath 48 can also include more than one metal. For example, molten bath 48 can include a solution of immiscible metals, such as iron and nickel. In one embodiment, molten bath 48 can be formed substantially of elemental metal. Alternatively, molten bath 48 can be formed substantially of metal salts. Molten bath 48 is formed by at least partially filling reactor 12 with a suitable metal or metal salt. In another embodiment, molten bath 48 is formed of immiscible metals. These immiscible metals can include first metal 50, such as iron, and second metal 52, such as copper. Molten metal 48 is then heated by a suitable means, such as by an induction coil or oxyfuel burner, not shown.

Suitable operating conditions of system 10 include, for example, a temperature which is sufficient to at least partially convert carbonaceous feed by dissociation to elemental carbon and other elemental constituents. Generally, a temperature in the range of between about 1,300° and 1,700° C. is suitable.

Vitreous layer 54 is formed on molten bath 48. Vitreous layer 54 is substantially immiscible with molten bath 48. Vitreous layer 54 can have a lower thermal conductivity than that of molten bath 48. Radiant heat loss from molten bath 48 can thereby be reduced to significantly below the radiant heat loss from molten bath 48 where no vitreous layer is present.

Typically, vitreous layer 54 can include at least one metal oxide. Vitreous layer 54 can contain a suitable compound for scrubbing halogens, such as chlorine or fluorine, to prevent formation of hydrogen halide gases, such as hydrogen chloride. In one embodiment, vitreous layer 54 comprises a metal oxide having a free energy of oxidation at the operation conditions of system 10, which is less than that from the oxidation of atomic carbon to carbon monoxide, such as calcium oxide (CaO).

Feed material, such as a suitable gaseous, liquid or solid feed, is directed into mixing zone 56, from feed material source 28 through line 26 to feed material tube 22 in tuyere 20 towards molten bath 48. Feed material enters mixing zone 56 at feed material inlet 24. A wide variety of feed materials which include organic waste can be used. An example of a suitable organic waste is a hydrogen-containing carbonaceous material, such as oil or a waste which includes organic compounds containing nitrogen, sulfur, oxygen, etc. It is to be understood that the organic waste can include inorganic compounds. In addition to carbon and hydrogen, the organic waste can include other atomic constituents, such as halogens, metals, etc. Oxygen gas or another oxidizing agent is directed from oxidizing agent source 36 through line 35 to oxidizing agent tube 38 into mixing zone 56. A suitable shroud gas, such as hydrocarbon or inert gas, is directed from shroud gas source 42 through line 40 to shroud gas tube 38.

Figure 2:
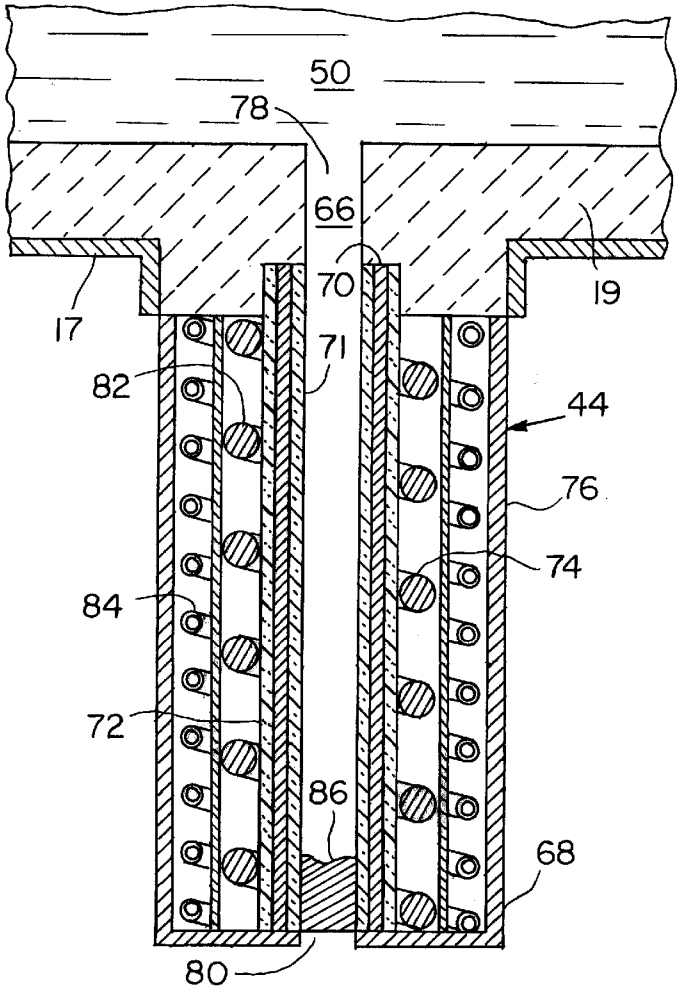
FIG. 2 is a cut-away side elevational view of the tapping apparatus shown in FIG. 1.

As can be seen in greater detail in FIG. 2, tapping assembly 44, which is a submerged outlet for controlling the level of molten bath 50. Tapping assembly 44 is formed of materials suitable for use in tapping. Tapping assembly 44 having first end 66 and second end 68 includes a centrally mounted tapping pipe 70, which can be ceramic pipe 71 inserted in the electrically conducting tubular section of the tapping assembly 44, also referred to as a susceptor, surrounded annularly by thermal insulating material layer 72. Tapping pipe 70 and thermal insulating layer 72 are annularly within induction coil 74. Induction coil 74 is helically wound around tapping pipe 70. In a preferred embodiment, induction coil 74 is wound around tapping pipe 70 to provide efficient energy to allow solid material contained within the tapping conduit prior to tapping to melt along the entire conduit with a "space factor" in the range of between about fifty and ninety percent and preferably between about seventy and eighty-five percent in order to allow sufficient heating when the power to the coil is switched on and, more importantly, to allow efficient cooling of the conduit when the coil power is off. The term "space factor" is understood to mean the percentage of the susceptor surface covered by the coil. Induction coil 74 preferably covers at least 60% of the length of the susceptor. Furthermore, the distal end of tapping pipe 70 at second end 68 of tapping assembly 44 should preferably extend less than about 150 mm from the outermost turn of induction coil 74, preferably less than about 50 mm and most preferably less than about 10 mm. Induction coil 74 can be surrounded by an optional magnetic shield, such as a cooled copper jacket, shunts and the like. Tapping assembly 44 is preferentially housed in metal sleeve 76 in which the parts of tapping assembly 70 are held in place by refractory or other mechanical means. Tapping assembly 44 is mounted with tapping pipe inlet 78 proximate to molten bath 48 and refractory lining 19 of reactor 12. Tapping pipe outlet 80 is at the other end of tapping pipe 70.

Tapping assembly 44 can be attached to a molten metal reactor in several locations. Tapping pipe 70 mounted at lower portion 16 of reactor 12 can drain or intermittently tap reactor 12 to adjust the level of molten bath 48. In embodiments where two liquid phases are tapped, tapping assembly 44 is positioned at the respective intended level of the two phases.

Metal sleeve 76 is preferentially made of a non-magnetic alloy, such as stainless steel. Metal sleeve 76 can be bolted directly onto an enclosed material receptacle or to another enclosed conduit connected to an enclosed material receptacle, neither of which are shown. Induction coil 82 is annularly positioned around thermal insulating layer 72 and can provide sufficient energy to tapping pipe 70 to heat the pipe which can, in turn, heat the metal within tapping pipe 70.

The frequency of the AC current supplied to induction coil 74 is chosen such that heat is directed to susceptor 70 of tapping assembly 44 and not to material present in the conduit. Typically, the frequency should be greater than 6 Khz. For example, a frequency of 10 Khz directs over 90% of the induction heating to the outermost 17 mm of a graphite susceptor which makes it a suitable frequency if the susceptor wall thickness is about 25 mm.

Power levels of about 10 to 150 kilowatts at about 200 to 1500 amperes are typically applied, depending on the size of susceptor 70 and desired tapping valve assembly opening times. The selection of high frequency to primarily heat susceptor 70 is essential to eliminate the risk that solid plug 86 in the tapping conduit bursts the susceptor through its thermal expansion should susceptor 70 and electrically conducting plug 86, such as a metal plug, be heated simultaneously which would be the case at lower induction coil current frequencies. For a similar reason, relatively high power should be applied in the beginning of the tapping valve opening procedure. For example, a typical starting power level can be about 40 Kw, which brings a 600 mm long susceptor of 75 mm outer diameter to about 1,500° C. in about 10 minutes, depending on the selected thermal insulation surrounding the susceptor. At a temperature in this range, the power is reduced to about 3 to 6 Kw, depending on the selected insulation, to avoid overheating and to allow heat to dissipate to regions not immediately under coil assembly 44. This procedure allows the development of a liquid film around melting plug 86 which can flow out of areas where plug thermal expansion can apply radial stress on the susceptor.

Induction coil 74 is preferably protected from mechanical damage and possible damage from melt emanating from reactor 12 by a thick layer of suitable refractory with sufficiently high thermal conductivity and low porosity. Castable refractories with thermal conductivities about 2 W/Mk at 1,300° C. and porosities below 25%, preferably below about 20%, are suitable.

Magnetic shield 84 is disposed annularly between induction coil 82 and metal sleeve 76 and protects surrounding metal components from the magnetic flux generated by operating the induction coil assembly 74. In addition, the use of the cooled shield reduces the temperature of the reactor refractory where the tapping assembly 44 is attached to the reactor wall which reduces refractory wear. In the event molten material should find a path through the joints where the tapping assembly 44 is attached to the reactor, the cooling capacity of the magnetic shield aids in freezing such material, arresting such undesired flow. Cooling fluid in magnetic shield 84 can be water, steam or gas, for example. Tapping assembly 44 is preferentially designed and fabricated in such a manner that allows easy disassembly for maintenance or replacement of any of its integral parts.

When cool, tapping pipe 70 contains solid plug 86. Plug 86 can be formed of molten material trapped and solidified in tapping pipe 70 subsequent to closing tapping assembly 44 during intermittent tapping operations or by an initial plug inserted into tapping pipe 70 prior to tapping operations. The initial plug material can be chosen from solid metal rods of a diameter similar to tapping pipe 70 (susceptor or ceramic cylinder), glass rods of similar diameter or rods of any other material which can be chemically compatible with the material to be tapped and the desired properties of the tap and collected molten material. The melting points of the initial plug materials are preferably similar to or higher than the melting points of the molten material to be tapped.

Induction coil 82 of tapping assembly 44 can induce heat in at least and preferably only tapping pipe 70 (susceptor) to heat and melt plug 86 contained therein primarily by axial and radial conduction of heat. Tapping pipe 70 is formed of a material which heats upon application of an induction current, while the surrounding material is not substantially heated with the induction current. Further, the tapping pipe is formed of a material which has a greater coefficient of thermal expansion than the material within the tapping pipe, such as the metal plug. An example of a material that tapping pipe 70 is formed of includes fine grained graphite, alumina graphite, or other sufficiently electrically conducting materials to allow efficient induction heating and which do not lose their integrity at the elevated temperatures required, typically in the range of between about 1,000° and 1,700° C. The electrical resistivity of the electrically conducting material preferably should not exceed 4.0 mΩcm at the operating conditions. Other components of tapping assembly 44 should be substantially electrically non-conducting with the exception of components used for housing 76 of tapping assembly 44 which can be electrically conducting but should preferably be non-magnetic. Tapping pipe 70, when used as the tapping pipe without a ceramic cylindrical insert 71 can have a protective refractory coating on the interior surface. Examples of suitable refractory coatings include coatings formed of alpha-silicon nitride ($\alpha$-$Si_3N_4$), titanium carbide (TiC) or boron nitride (BN). In one embodiment, tapping pipe 70 has a length of between about two and three feet and is tubular in shape. Further, tapping pipe 70 can have an inside diameter in a range of between about 10 and 70 millimeters and can have an outside diameter in a range of between about 50 and 200 millimeters.

The frequency of the current used to operate induction coil 82 is preferably selected to develop induction heating in the wall of tapping pipe 70 only. An example of a suitable current is between about 5,000 and 10,000 Hertz, depending on the tapping pipe wall thickness. If the wall thickness is about 25 millimeters, then ninety-five percent of the induction heating occurs in the outer 17 millimeters of the wall at 10,000 Hertz. Greater susceptor wall thickness allows the selection of lower frequencies within the range. Power levels of between about 10 and 150 kilowatts at between about 300 and 1,500 amperes are typically applied, depending on the size of the susceptor and desired valve opening times. The selection of high frequency to primarily heat tapping pipe 70 is essential to eliminate the risk that solid plug 88 in the tapping conduit bursts the susceptor by its thermal expansion should the tapping pipe and an electrically conducting plug, such as a metal plug, be heated simultaneously which would be the case at lower induction coil current frequencies. For a similar reason, relatively high power should be applied in the beginning of the tapping valve opening procedure. For example, a typical starting power level can be about 40 Kw, which can heat a 600 millimeters long tapping pipe with a 75 millimeters outer diameter to about 1,500° C. in about 10 minutes, depending on the selected thermal insulation surrounding tapping pipe 70. At a temperature in this range, the power is reduced to between about 3 and 6 Kw, depending on the selected insulation, to avoid overheating and to allow heat to dissipate to regions not immediately under coil assembly 82. This procedure allows the development of a liquid film around the melting plug which can flow out of areas where plug thermal expansion can apply radial stress on tapping pipe 70.

Further, the high frequency reduces or eliminates metal melt movement in the tapping conduit while the induction coil power is on, reducing the wear of the conduit walls.

Once the plug has been at least partially melted by the induction heating in tapping pipe 70, tapping assembly 44 is opened by removing any mechanical obstacle to the flow, such as a slide gate or a stopper rod, or the like. By measuring the pressure change at the outer end of the tapping pipe, it can be determined when tapping assembly 44 is ready to be opened. This pressure change is measured at the pipe outlet to ascertain that the entire tapping conduit has been cleared of solid phase.

The rate of flow through tapping pipe 70 can be determined by the static pressure of molten bath 48 in the vessel, the density and viscosity of the molten bath 48 and the tapping pipe length and interior diameter. The rate of flow can be controlled by applying a pressure differential between enclosed reactor 12 and the enclosed liquid material receptacle connected to the vessel by the tapping assembly 44. The pressure differential can be used to initiate and accelerate the flow as well as by reducing the pressure differential to slow or stop the flow as long as the tapping pipe is full of liquid material. After a desired amount of molten metal 52 has been removed from the reactor 12, the flow can be stopped by a mechanical flow stopper located at the outer end of tapping assembly 44 or the flow can be stopped by applying a pressure differential between the receptacle and the metallurgical vessel which at least equals the static pressure inside the vessel. Once the flow is sufficiently slowed or stopped, the molten metal 50 in tapping pipe 70 is cooled by deactivating induction coil 82 so that molten metal 50 solidifies in plug 86 as a result of heat being withdrawn into the coolant of induction coil 82. The deactivation of induction coil 82 can occur at the moment flow is initiated, as typically is the case when molten metal 50 is tapped, or induction coil 82 can be deactivated when it is desired to stop the flow as is often the case when tapping molten ceramic material.

When induction coil 82 is deactivated, heat is conducted away from tapping pipe 70 and its contents through thermal insulation layer 72 to coolant of induction coil assembly 82. The cooling action of the induction coil assembly can be used to control the position of the solid/liquid interface within tapping assembly 44 among plug 86, tapping pipe 70 and liquid material inside reactor 12. In some embodiments, it is important to maintain the solid/liquid interface proximate to tapping pipe inlet 78 of tapping pipe 70 to minimize erosion, corrosion and other unwanted effects caused by extended exposure of the tapping conduit to the melt within the reactor.

The thermal insulation is chosen to minimize heat losses to the coil assembly cooling water when the induction coil is activated during tapping and to maximize the heat extraction when the coil assembly is not activated. For example, it has been found that fibrous ceramic insulating materials with thermal conductivities in the range of between about 0.06 and 0.2 W/Mk at room temperature and between about 0.2 and 0.5 W/Mk at 1,500° C. applied to the thicknesses in the range of between about 5 and 30 millimeters around the electrically conducting tubular component, having outer diameters in the range of between about 70 and 150 millimeters satisfy the requirement of maintaining an essentially solid plug in the tapping conduit between taps and the need to limit thermal losses when the tapping conduit is filled with molten material.

For example, if tapping pipe 70 is inserted into a highly erosion-resistant and corrosion-resistant refractory in reactor 12, it is advantageous to ensure that the solid/liquid interface is positioned in close proximity of refractory lining 19, thereby keeping molten bath 50 away from tapping pipe 70. This minimizes otherwise potentially excessive corrosion and erosion of tapping pipe 70 by molten metal 50 when the tapping assembly 44 is closed.

Thermal insulating layer 72 regulates the radial flow of heat from tapping pipe 70. Thermal insulation layer 72 is located between tapping pipe 70 and induction coil 82 and allows sufficient heat to be extracted from tapping pipe 70 while tapping assembly 44 is closed in order to control the position of the solid/liquid interface in the tapping assembly 44. As tapping pipe 70 is heated and begins to expand, heat is transferred to the metal and the metal begins to melt by conduction at the surface of tapping pipe 70.

Figure 3:
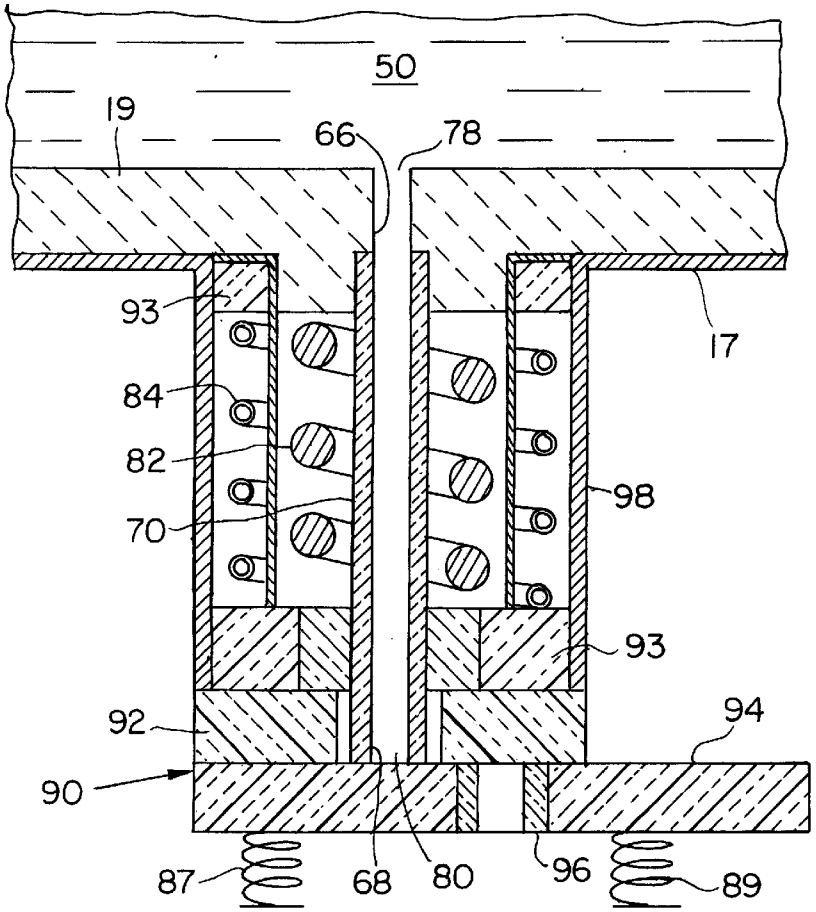
FIG. 3 is a cut-away side elevational view of a second embodiment of the tapping apparatus shown in FIGS. 1 and 2.

In a preferred embodiment shown in FIG. 3, tapping pipe outlet 80 is connected to slide gate assembly 90, whereby tapping pipe 70 extends through stationary plate 92. Slide gate assembly 90 helps control tapping of metal from ladles to tundishes, for example. Slide gate assembly 90 includes stationary plate 92 and moving plate 94. Stationary plate 92 is fixed and is connected to tapping pipe 70 at tapping pipe outlet 80. Tapping pipe 70 can have optional thermal insulator 93 that is annularly disposed about tapping pipe outlet 80 above components of stationary plate 92, which in itself includes additional thermally insulating components reducing heat flow in the radial direction about the part of tapping pipe 70 which extends into stationary plate 92. Stationary plate 92 can have optional thermal insulator 93 that is annularly disposed about tapping pipe outlet 80. Moving plate 94 includes ceramic insert 96 to protect moving plate thermally insulating components arranged axially below tapping pipe outlet 80, when the slide gate is in its closed position from contact with molten metal 52. Moving plate 94 can be moved between opened and closed positions to control flow of molten bath 48. Moving plate 94 is spring loaded against stationary plate 92 by springs 87, 89 to provide a seal at tapping pipe outlet 80.

The radially thermally insulating components of stationary plate 92 and the axially thermally insulating components of moving plate 94 of slide gate assembly 90 cause induction heat developed in tapping pipe 70 to be conducted to the portion of tapping pipe 70 in closest proximity of moving plate 94, causing metal or ceramic material (plug 86) in tapping pipe 70 to fully melt prior to opening slide gate assembly 90, thereby permitting a controlled flow of molten material through tapping pipe 70, stationary plate 92 and moving plate 94. After a sufficient amount of molten material has been tapped, slide valve assembly 90 is closed by sliding moving plate 94. The remaining molten material trapped inside stationary plate 92 of slide gate assembly 90 is solidified as induction heating is stopped in tapping assembly 44.

Stationary plate 92 and moving plate 94 are formed of materials which have suitable thermal properties, high compressive strength and smooth surfaces to facilitate the movement of the plates while under compressive stress.

Pyrolitic graphite can be used to form at least portions of stationary plate 92 and moving plate 94. This material includes layers of graphite in a highly ordered carbon structure that is vapor deposited resulting in a dense, oxidation resisting material with highly anisotropic thermal properties and smooth surfaces. The material exhibits very high thermal conductivity laterally through the structure, whereas the thermal conductivity in a direction perpendicular to the layers of the structure is very low. Typical thermal conductivities at room temperature for commercially available pyrolitic graphite (Carbograf—400, manufactured by Carbone Lorraine) range between about 300 and about 500 W/Mk in the direction of the layers of the structure but do not generally exceed about 3 W/Mk in the insulating direction. At typical operating temperatures of between about 1,400 and 1,900° K., the conductivity is reduced to about a third.

The pyrolitic graphite of stationary plate 92 is arranged such that radial conduction of heat is minimized, that is, with the layers of the material being substantially parallel with tapping pipe 70 so as to limit radial heat loss from tapping pipe 70. The pyrolitic graphite of moving plate 94, by contrast, has its layers arranged perpendicularly to the axis of tapping pipe 70 to limit the heat flow through it, thereby conducting heat from the susceptor under induction coil 82 to tapping pipe outlet 80. This arrangement allows a temperature of about 1,700° K. at tapping pipe outlet 80 proximate to stationary plate 92, while moving plate 94 can have a temperature of about 700° K. below tapping pipe outlet 80.

Slide gate assembly 90 can also include ceramic inserts 96 to protect the pyrolitic graphite from the molten metal flowing through it as well as additional thermal insulators, as shown in FIG. 3. The selection of such additional insulators and ceramic components depend on the thermal requirements and individual slide gate configurations. An example of a suitable material for forming insert 96 includes a fifty percent, by weight, alumina ($Al_2O_3$) and fifty percent silicon carbide (SiC) mixture.

In another embodiment, the pyrolitic graphite can be substituted by other known thermally insulating materials, such as refractory materials with low thermal conductivity and sufficient compressive strength to serve as slide gate plate components. Such refractory materials typically contain alumina, zirconia or other such metal oxides and are specifically characterized by their thermal conductivities which, at room temperature, should not exceed 3 W/Mk, preferably 1 W/Mk. These materials are employed to limit radial conduction of heat from tapping pipe and to allow the heat flow into moving plate 94 of slide gate assembly 90 in the direction of the axis of tapping pipe 70. The necessary metal components of slide gate assembly 90 are made of nonmagnetic metal or metal alloys, preferably stainless steel.

Figure 4:
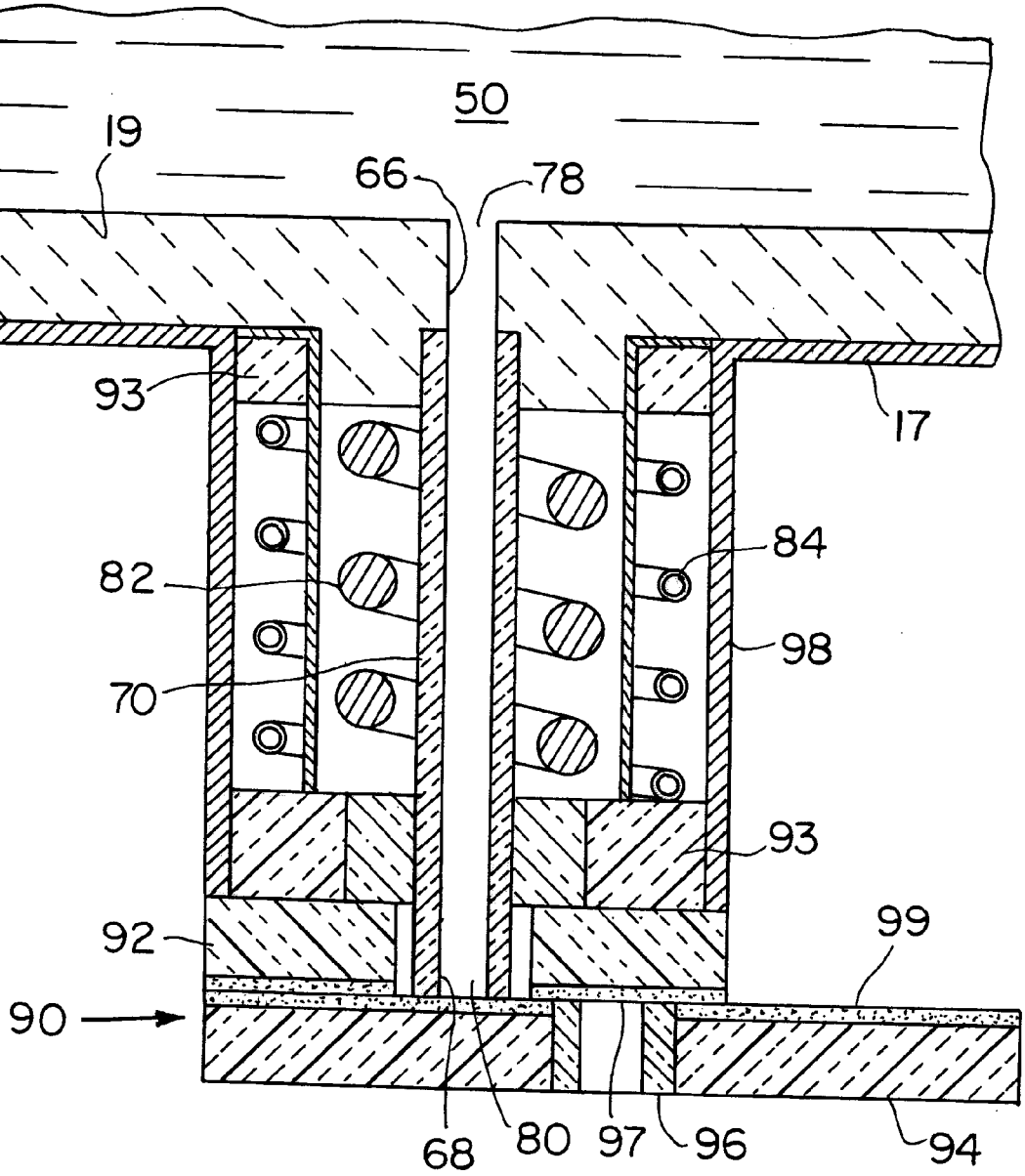
FIG. 4 is a cut-away side elevational view of a third embodiment of the tapping apparatus shown in FIGS. 1 and 2.

In one embodiment, shown in FIG. 4, stationary plate 92 and moving plate 94 have surface coating 97, 99. Surface coatings 97, 99 are formed of low friction materials, such as graphite, or alumina graphite and the like to facilitate plate movement. Ceramic insert 96 in the tapping conduit of moving plate protects the components of slide gate assembly 90 from molten bath 50 being tapped when slide gate assembly 90 is opened.

Slide gate assembly 90 is preferably installed in metal housing 98, which can be bolted directly onto an enclosed molten material receptacle or to an enclosed conduit leading to such an enclosed receptacle.

Intermittent tapping or final draining of molten bath 48 or slag 54 (molten vitreous layer) from reactor 12 can be achieved by employing a valve including induction coil 74 and tapping pipe 70 which are capable of melting a frozen plug of metal or slag present in tapping pipe 70. The melting of plug 86 provides an open passage through which molten bath 48 material within reactor 12 can be wholly or partially removed. The amount of power to be applied to the induction coil of tapping assembly 44 is adjusted to achieve melting of material within tapping pipe 70. In one embodiment, induction coil is activated at 10,000 Hz and a power in the range of between about 50 and 150 kilowatts. After plug 86 is melted, the power can be reduced to maintain the hottest portion of the susceptor at a predetermined maximum temperature which typically requires between about 3 and 10 Kw depending on the size of susceptor 70 and the thermal insulation applied.

To determine whether frozen plug 86 has melted, a mechanical stopper, such as a slide gate moving plate or a simple stopper rod operated along the axis of tapping pipe 70, can be removed to allow a predetermined amount of molten material to pass through tapping assembly 44. This embodiment of the invention includes measurement of the pressure in tapping pipe 70 while plug 86 is present in tapping pipe 70 in solid form when the pressure equals that of the surroundings of frozen plug 86 within tapping pipe 70. The pressure undergoes a change when plug 86 becomes fully molten, or at least sufficiently molten to communicate the additional pressure caused by the height of the liquid molten material contained in the reactor or furnace. By acquiring a positive indication by any mechanical means of such a pressure change at tapping pipe outlet so it is ascertained that the frozen plug is sufficiently molten that liquid material in the furnace or reactor can safely be removed.

Figure 5:
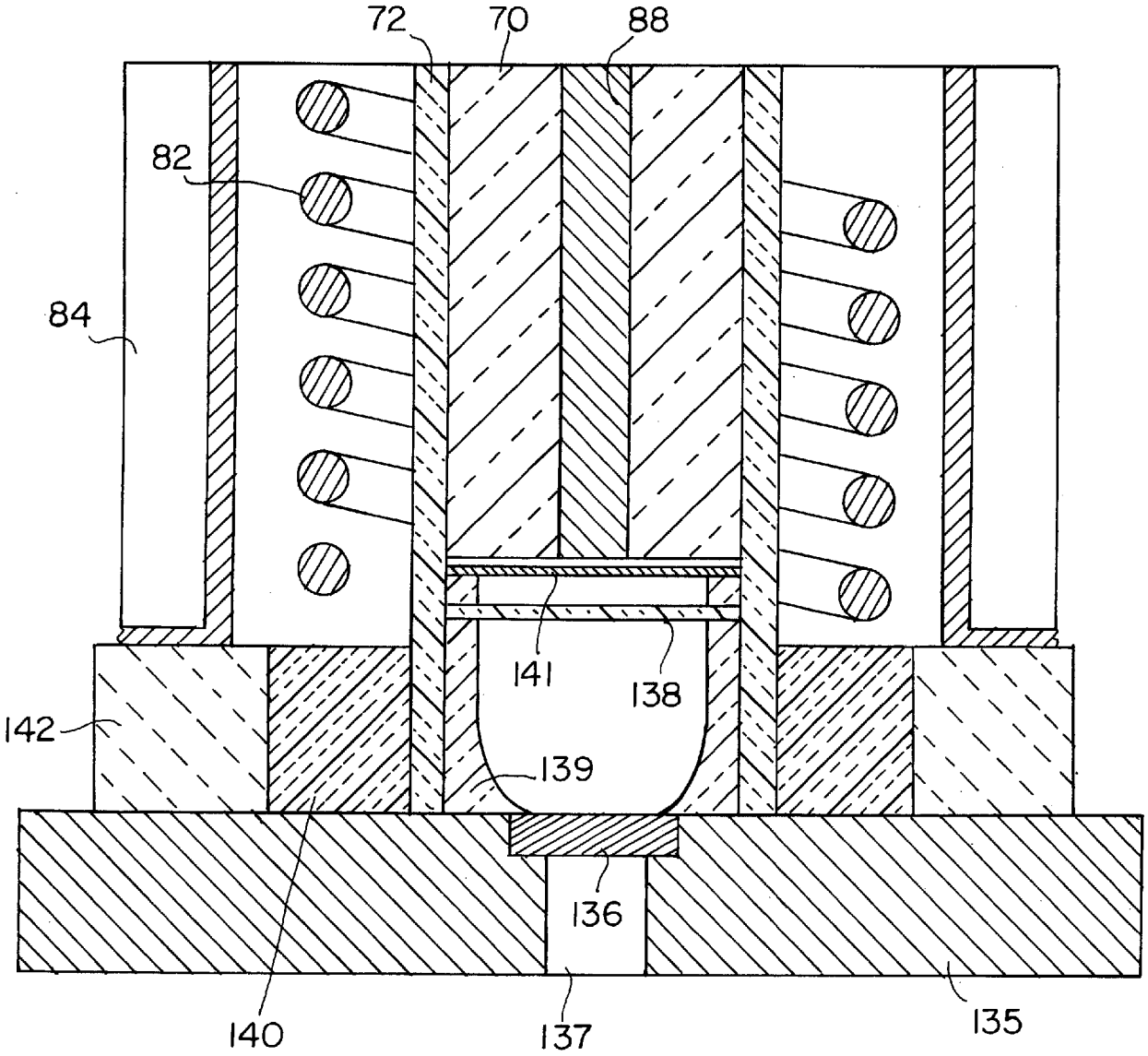
FIG. 5 is a cut-away side elevational view of a fourth embodiment of the apparatus of the present invention.

The embodiment schematically shown in FIG. 5 discloses a tapping valve assembly which is advantageously used in embodiments when reactor 12 needs to be fully drained when processing has been completed. In this embodiment, tapping assembly 44 is equipped with flange 135 attached to metal sleeve 76. Flange 135 maintains a seal around tapping assembly 44 forming a pressure boundary between reactor 12 and the outside of flange 135. Flange 135 is preferably made of a nonmagnetic alloy, such as stainless steel. Flange 135 has a central opening located under the outlet of tapping pipe 70. This opening has insert 136 which is formed of a metal or metal alloy with a melting point below that of the metal to be tapped from reactor 12. A preferred metal is copper. The thickness of insert 136 is governed by reactor 12 operating pressure and the diameter of insert 136. For example, if the operating pressure is about 10 bar and the disc diameter is about 50 millimeters, then the insert thickness should be about 6.4 millimeters. Although not shown in FIG. 5, insert 136 in flange 135 can be inserted in additional inserts with successively larger diameters and greater thickness all of which have melting points below or substantially equal to that of the tapped metal or below the temperature at which the molten material is being withdrawn and below that of flange 135. A multiple insert arrangement reduces the required thickness of the central insert.

The space above insert 136 includes heat barriers to limit the amount of heat radiated and conducted from tapping pipe 70 and metal plug 88 to flange 135 and metal sleeve 76. In a preferred embodiment, the components of the space include thermally insulating layer 138 which arrests radiant heat emanating from above when induction coil assembly 82 is activated, a ceramic or refractory shape 139, insulating materials 72, 140 arranged annularly about ceramic or refractory shape 139 and a metal disc 141 with a melting point substantially above that of at least the central insert 136 and above that of metal plug 88, but below that of flange 135. Induction coil assembly can be supported by shapes 142 which can be made of refractory materials or other electrically non-conducting materials of high melting points. Thermal insulation 138 can include zirconia felt, a fibrous flexible material with low emissivity and thermal conductivity. The zirconia felt can be applied in several layers to the thickness required to substantially contain heat radiated onto it from metal disc 141 in the space between thermal insulation 138 and metal disc 141. The zirconia felt can have slits cut into individual layers of felt in such fashion that molten metal emanating from above forces insulation 138 aside providing a clear path for molten metal between tapping pipe 70 and insert 136. Insulation 138 can include any known thermally insulating material which can substantially contain radiant heat in the space between insulation 138 and metal disc 141 and provides a path for molten metal downward when contacted by the metal. Refractory or ceramic shape 139 serves to separate molten metal from thermal insulation 72 and is made of a material which withstands thermal shock, such as, for example, porous alumina, zirconia or other metal oxides and are specifically characterized by their thermal conductivities which, at room temperature, should not exceed 1 W/Mk.

Metal disc 141 is selected such that it contains molten plug 88 within the tapping conduit until it has reached a temperature at which the quantity of molten metal entering the space between insulation 138 and insert 136 contains enough heat to readily melt insert 136 and continue to flow through the opening in flange 135. The opening in flange 135 is preferably filled with a loose fitting thermal insulator 137, which contains heat in insert 136 as it is contacted by molten metal.

Figure 6:
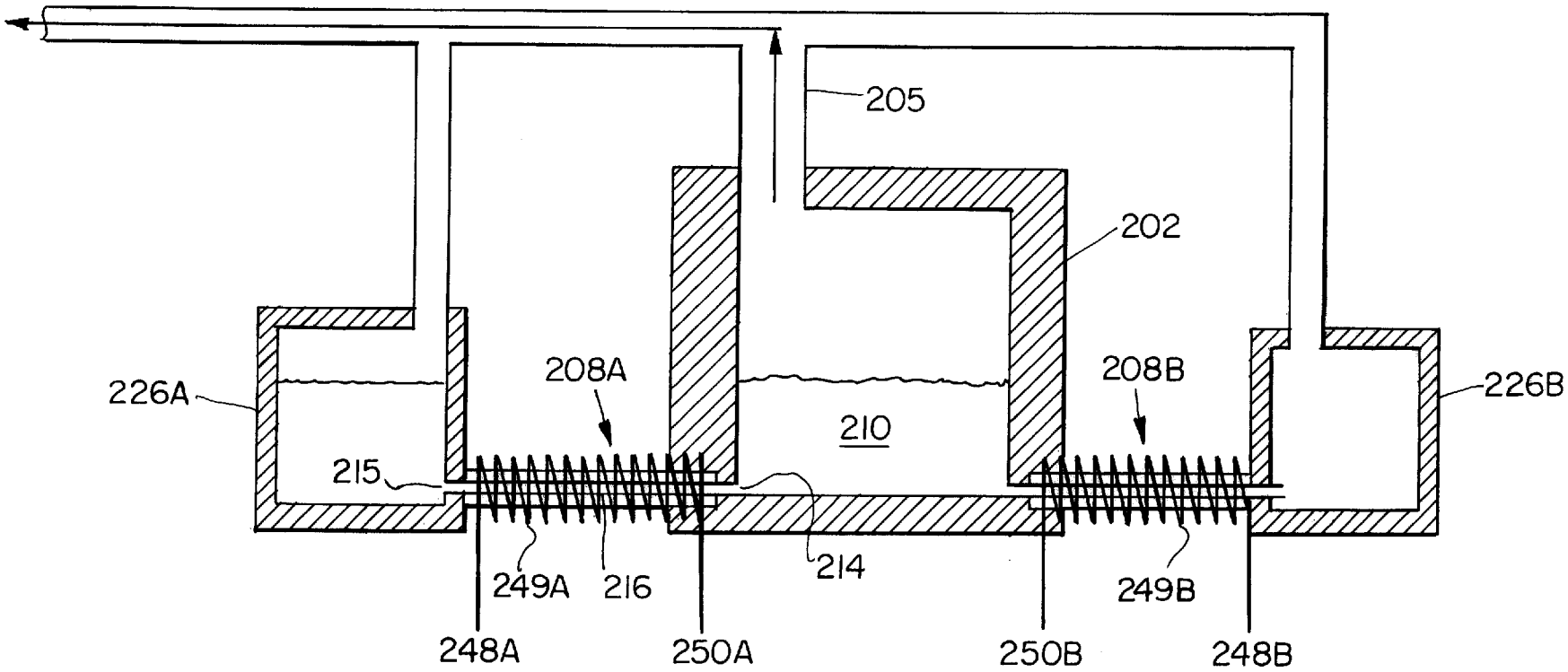
FIG. 6 is a cut-away side elevational view of a fifth embodiment of the apparatus of this invention.

The embodiment schematically shown in FIG. 6 refers to a tapping valve assembly which is advantageously used in cases where reactor 202 needs to be intermittently tapped by means of removing known quantities of melt in a batch-wise fashion before processing has ended and when it needs to be fully drained when processing has been completed. In this embodiment, tapping assembly 208A and tapping assembly 208B are attached to reactor 202 and receptacles 226A, 226B. The operating pressure of reactor 202 is communicated to receptacles 226A, 226B, for example, as shown in FIG. 6, by interconnecting the off-gas stream 205. This feature is particularly advantageous if the processing of feedstock in reactor 202 is associated with fluctuating reactor pressure.

The apparatus of the invention comprises one or more induction controlled tapping assemblies 208A, 208B linking the reactor or furnace with molten material receptacles 226A, 226B. Tapping assemblies 208A, 208B includes a tapping conduit surrounded by an electrically conducting material which can be heated by means of induction, in turn heating and melting solidified material present in the tapping conduit so as to open a passage for molten material and allowing the molten material to flow from reactor 202 into receptacles 226A, 226B. Receptacles 226A, 226B are designed and positioned to allow the level molten material in the receptacle 226A, 226B equal that of the melt in reactor 202, thereby removing a desired amount of melt from the reactor or furnace. In this fashion, depending on the location of the receptacle relative to the reactor, the portion of melt removed from reactor 202 can be selected to equal any fraction of melt in reactor 202 including the entire amount of melt.

Tapping valve assemblies 208A, 208B include tapping pipe 216 having tapping pipe inlet 214 and tapping pipe outlet 215 for withdrawing portions of the molten bath from the reactor. Tapping pipe 215 is attached to reactor 202 at tapping pipe inlet 214 at a level where desired amounts of the molten bath can be withdrawn. The tapping pipe is an integral component of tapping assembly 208 which includes a tubular shape of electrically conducting material 218, such as graphite or graphite-refractory composites, such as alumina graphite, which can be inductively heated to temperatures of at least up to 1,700° C. without losing its mechanical integrity or other properties essential to its functionality, such as its electrical and thermal conductivity.

When tapping pipe 218 is used to tap materials which are not excessively chemically aggressive to graphite, the tapping pipe itself can be made of graphite or a graphite-refractory composite material, graphite being the preferred material. When the tapping pipe is used to convey melts which are chemically or otherwise aggressive to graphite, the graphite pipe needs to be protected by a layer of material which resists dissolution, corrosion and erosion by the melt. For example, when conveying an iron based melt which is not saturated with regard to carbon, a graphite conduit can be protected by a layer of boron nitride or by a tubular ceramic structure inserted into the conduit, such as, for example, low porosity alumina silicon carbide composites with silicon carbide contents typically in the 5 to 30 weight percent range. The ceramic material can typically have a wall thickness of about 3 to 10 mm and should exhibit resistance to thermal shock at heating rates of at least up to 150° C. per minute. The tubular electrically conducting component of the tapping assembly is annularly disposed about the ceramic tapping pipe and the tapping conduit.

A thermal insulator is annularly disposed about the tubular electrically conducting component of tapping assembly 208. A cooled induction coil assembly is annularly disposed about the thermal insulator allowing the induction coil assembly to inductively heat the electrically conductive tubular component of the assembly, which either directly, or by conduction through the ceramic tapping pipe, heats the tapping conduit to melt a solid material (plug) within the tapping conduit thereby allowing molten material to flow from reactor 202 through tapping pipe 216 into selected receptacles 226A and 226B.

During processing and prior to initiating withdrawal of melt from the reactor, the cooling capability of induction coil assembly 220 is used to extract heat from the tapping conduit to maintain a maximum amount of the material contained in the tapping conduit in solid form to minimize erosion, corrosion and other unwanted effects caused by extended exposure of the tapping conduit to the melt within the reactor.

The thermal insulation therefore should be chosen accordingly, both to minimize heat losses to the coil assembly cooling water when the induction coil is activated during tapping and to maximize the heat extraction when the coil assembly is not activated. For example, it has been found that fibrous ceramic insulating materials with thermal conductivities in the range of 0.05 to 0.3 W/Mk at room temperature and 0.2 to 0.8 W/Mk at 1,500° C. applied in thicknesses of 5 to 30 mm around the electrically conducting tubular component, having outer-diameters in the range of 70 to 150 mm satisfy the requirement maintaining essentially solidified material in the tapping conduit between taps and the need to limit thermal losses when the tapping valve assembly is inductively heated to allow the withdrawal of melt from reactor 202 to selected receptacles 226A, 226B.

Figure 7:
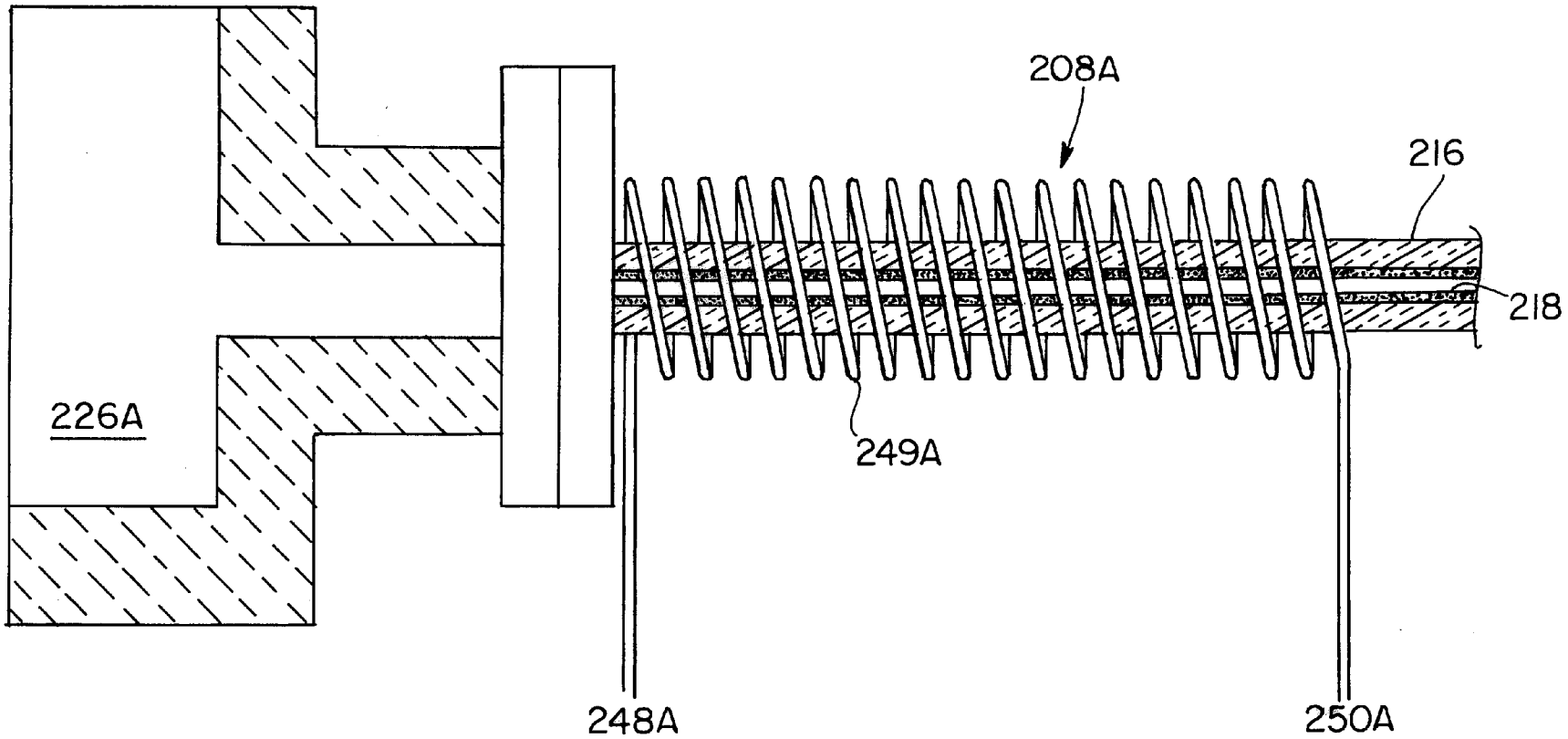
FIG. 7 shows a detailed section of FIG. 8.

In the embodiment shown in FIG. 7, tapping assemblies 208A, 208B are equipped with induction coils which are connected to power sources generating alternating current. Coolant is continually passed through the entire coil from points 248A to 250A and 248B to 250B, respectively. While feedstock is being processed in reactor 202, the tapping conduits are blocked with solidified material from which heat is extracted to the induction coil coolant stream. Receptacles 226A, 226B are maintained at reactor pressure during processing and connected to process off gas stream 205.

Alternating current is applied to the entire induction coil between points 248A to 250A and 248B to 250B respectively, when it is desired to remove a portion of the melt from the reactor. The material in the conduit is melted and melt from reactor 202 flows to the selected receptacle until the melt levels in the selected receptacle and the reactor are equal. The location of receptacle 226 bottom can optionally be selected such that the entire reactor melt inventory can be removed. The power applied to the induction coil can be switched off when flow commences or adjusted to a low level so as not to overheat the tapping valve assembly components while tapping is in progress. When tapping is completed, the power is switched off, the coolant flow through the induction coil causes the melt in the tapping conduit to solidify and processing in reactor 202 can resume.

When the melt transferred from reactor 202 to selected receptacles 226A, 226B has solidified in the receptacle, the receptacle can be exchanged for an empty receptacle to perform additional tapping. The receptacle can be removed after power has been applied to an outer portion of the coil, between coil taps 248A and 249A or 248A and 248B to melt the outer end of the solidified material in the tapping conduit to allow removal of receptacle 226.

Figure 8:
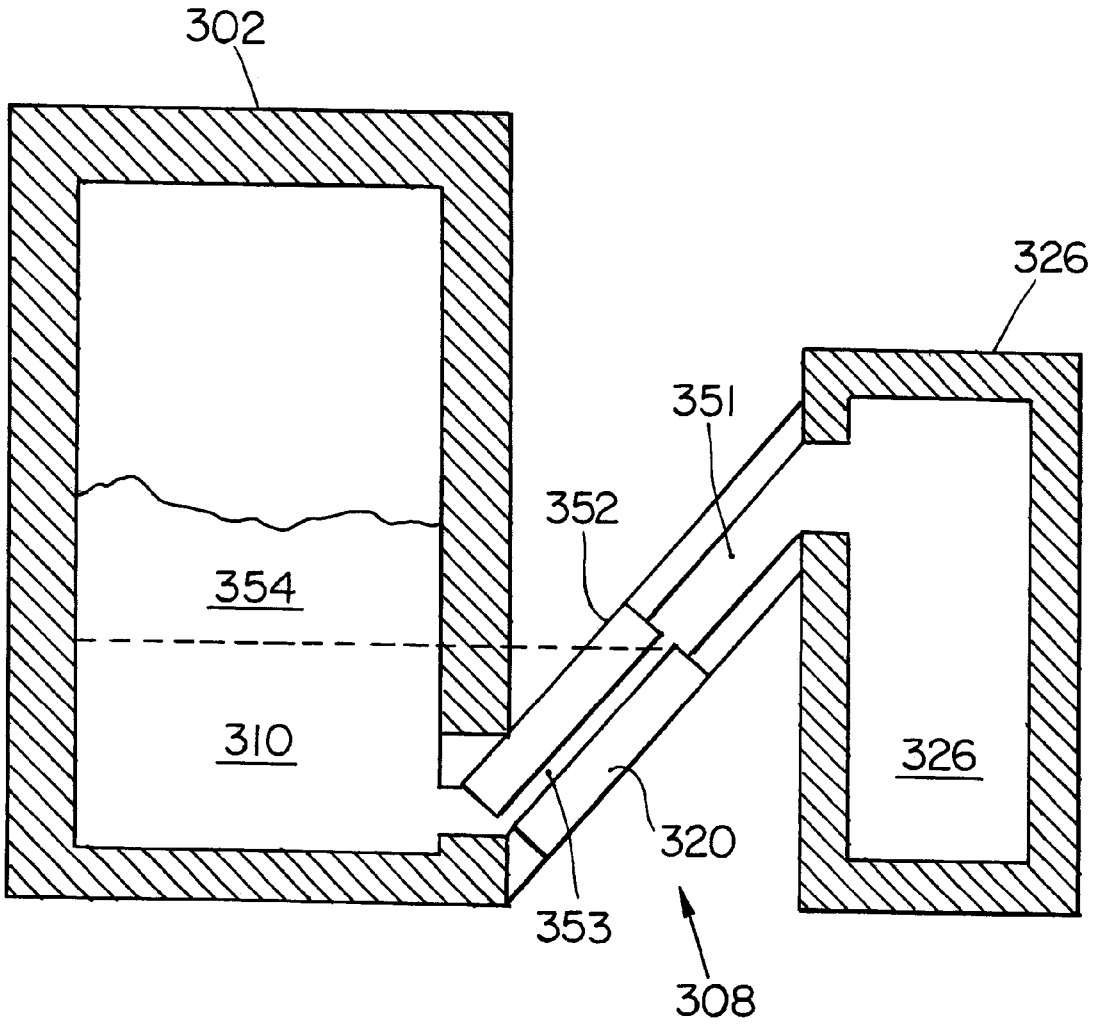
FIG. 8 is a cut-away side elevational view of an sixth embodiment of the apparatus of the invention.

A further embodiment of the invention is shown in FIG. 8 and refers to a tapping valve assembly which is advantageously used in cases where reactor 302 needs to be intermittently tapped in a remote controlled fashion. In this embodiment, tapping assembly 308 is used in a system comprising reactor 302 containing melt 310, receptacle 326, angled conduit 352, with induction heating and cooling coil 320. Conduit 352 is electrically heated by means of induction heating and by melt entering the conduit. Conduit 352 has at least two different inner diameters or cross sectional areas. Narrow conduit 353 under the cooling/induction heating coil allows effective cooling of the melt after each tap and effective heating before each tap to rapidly solidify or melt the material contained therein.

Unheated, wider portion 351 of conduit 352 provides a beneficial surface to volume ratio to avoid solidification of melt in transit. By moving a sufficiently large quantity of superheated melt per unit time through the larger cross section conduit, the walls of the conduit become effectively heated to a temperature where no melt can solidify onto them. At the end of the tap, the inner walls of the unheated conduit are hot enough to allow remaining melt in the conduit to flow back to the cooling/induction heating coil 320 position. The movement of the melt is caused by establishing a pressure differential over cooling coil 320 region in known ways, by either elevating reactor 302 pressure over that of receptacle 326 or by lowering the pressure of receptacle 325 to a level below that of reactor 302. After each transfer of melt 310 in batches to receptacle 325, level 354 of remaining melt in the reactor should be such that the melt in conduit 352 reaches the upper end of the cooling/induction heating coil 320 or to any point below, as long as enough melt remains in the cooling/heating coil region to provide a positive barrier in its solidified form to prevent melt 310 from reactor 302 from entering into conduit 352.

EQUIVALENTS

Those skilled in the art will recognize, or be able to ascertain using no more than routine experimentation, many equivalents to specific embodiments of the invention described specifically herein. Such equivalents are intended to be encompassed in the scope of the following claims.

We claim:

1. An apparatus for tapping a molten metal bath from a reactor, comprising:

a) a tapping pipe, having a tapping pipe inlet and a tapping pipe outlet, said tapping pipe being attachable at said tapping pipe inlet to the reactor and said tapping pipe including a susceptor, whereby said tapping pipe can be heated by an induction current to a higher temperature than that of a solidified bath metal component within said tapping pipe;

b) an induction means at the tapping pipe, wherein said induction means can apply an induction current to the susceptor to heat the tapping pipe to a temperature that is higher than that of said bath metal within said tapping pipe and thereby melt said solidified bath metal to tap the molten metal bath from the reactor; and c) a ceramic insert that lines the tapping pipe to substantially prevent contact of the tapping pipe by the metal melt being tapped through said tapping pipe.

2. The apparatus of claim 1 wherein said susceptor component of the tapping pipe includes graphite.

3. The apparatus of claim 2 wherein said susceptor component further includes aluminum oxide.

4. The apparatus of claim 2 wherein said susceptor component further includes zirconium oxide.

5. The apparatus of claim 1 wherein said susceptor component of the tapping pipe has an electrical resistivity of greater than about 1.0 mΩcm.

6. The apparatus of claim 1 wherein the induction means includes an induction coil assembly annularly disposed about the tapping pipe.

7. The apparatus of claim 6 wherein the induction coil assembly is embedded in a refractory layer.

8. The apparatus of claim 7 wherein the refractory layer has a thickness of at least about 15 mm.

9. The apparatus of claim 8 wherein the refractory material has a porosity of less than about 25%, by weight.

10. The apparatus of claim 9 wherein the refractory material has a thermal conductivity greater than about 2.5 W/Mk at about 25° C.

11. The apparatus of claim 6 wherein at least about 60% of the tapping pipe is covered by said induction coil.

12. The apparatus of claim 6 wherein the said tapping pipe outlet extends less than about 120 mm beyond the induction coil.

13. The apparatus of claim 12 wherein the said tapping pipe outlet extends less than about 50 mm beyond the induction coil.

14. The apparatus of claim 13 wherein the said tapping pipe outlet extends less than about 20 mm beyond the induction coil.

15. The apparatus of claim 14 wherein the tapping pipe, outlet does not extend beyond the induction coil.

16. The apparatus of claim 2 further including a copper shield that extends about said induction coil.

17. The apparatus of claim 1 wherein said ceramic insert includes aluminum oxide and silicon carbide.

18. The apparatus of claim 1 wherein said tapping pipe is attached at a bottom portion of said reactor.

19. The apparatus of claim 1 wherein said tapping pipe is attached at a side wall of said reactor.

20. The apparatus of claim 1 further including controlling means at said induction means for remote control of the temperature of the tapping pipe.

21. The apparatus of claim 1 further including a slidable gate valve assembly at said tapping pipe outlet.

22. The apparatus of claim 21 wherein said slidable gate valve assembly includes a stationary plate that is in a fixed position at the tapping pipe outlet, and a slidable plate at said stationary plate which can slide between a first position that can block a path of flow of molten metal from tapping pipe outlet, and a second position that does not block said flow.

23. The apparatus of claim 22 further including a lubricant between said stationary plate and said slidable plate.

24. The apparatus of claim 22 wherein at least one of said stationary plate and said slidable plate includes a thermal insulating material.

25. The apparatus of claim 24 wherein the thermal conductivity of said stationary plate and of said moving plate does not exceed about 1.0 W/Mk at a temperature of about 1,400° C.

26. The apparatus of claim 24 wherein the thermal conductivity of said stationary plate and of said moving plate does not exceed about 1.0 W/Mk at a temperature of about 25° C.

27. The apparatus of claim 24 wherein said thermal insulating material has a thickness greater than about 20 mm.

28. The apparatus of claim 24 wherein said thermal insulating material includes pyrolytic graphite, having parallel layers of the graphite oriented at a right angle to a direction of heat transfer from said molten metal within said tapping pipe.

29. The apparatus of claim 1 further including a cooling means at said tapping pipe.

30. The apparatus of claim 1 further including:

a) a sleeve annularly disposed about said induction coil;

b) a flange at one end of said sleeve and proximate to said tapping pipe outlet, said flange defining an orifice at said tapping pipe outlet; and c) at least one insert at said orifice, said insert having a melting point below that of said flange.

31. The apparatus of claim 30 wherein said insert includes copper or a copper alloy.

32. The apparatus of claim 30 wherein more than one insert is located at said orifice.

33. The apparatus of claim 32 wherein said inserts have successively larger diameters along a path of flow of metal melt from said tapping pipe outlet, and all of said inserts having melting points below the temperature of the tapped material and below that of said flange.

34. The apparatus of claim 32 wherein said inserts have successively greater thicknesses along a path of flow of metal melt from said tapping pipe outlet, and all of said inserts having melting points below the temperature of the tapped material and below that of said flange.

35. The apparatus of claim 30 further including an obstacle means to delay initiation of flow of metal melt from said tapping pipe outlet.

36. The apparatus of claim 35 wherein said obstacle means is a metal disc at said outlet of said tapping pipe, said disc having a melting point above that of said insert, above that of the tapped metal melt, and below that of said flange.

37. The apparatus of claim 35 wherein at least one thermal insulating layer is present between said insert and said tapping pipe outlet.

38. The apparatus of claim 37 wherein said thermal insulating layer includes a fibrous flexible refractory material.

39. The apparatus of claim 37 wherein said insulating layer defines at least one opening, whereby melt emanating from said tapping pipe outlet can contact said insert.

40. The apparatus of claim 1, wherein said induction means has at least two zones which are separately controllable, whereby an inductive current can be directed through one or more of said zones.

41. The apparatus of claim 40, wherein said induction means has at least three zones.

42. The apparatus of claim 1, wherein said tapping pipe is attached to said reactor in an inclined position.

43. The apparatus of claim 42, wherein said tapping pipe outlet includes a portion that has a cross-sectioned area greater than a portion of the tapping pipe more proximate to said induction means.

44. The apparatus of claim 43 further including a receptacle at said tapping pipe outlet.

45. The apparatus of claim 1 further including a removable plug at the tapping pipe outlet.

46. An apparatus for tapping a molten metal bath from a reactor, comprising:

a) a tapping pipe, having a tapping pipe inlet and a tapping pipe outlet, said tapping pipe being attachable at said tapping pipe inlet to a reactor, and said tapping pipe including a susceptor, whereby said tapping pipe can be heated by an induction current to a higher temperature than that of a solidified bath metal within said tapping pipe;

b) a ceramic insert that lines the tapping pipe to substantially prevent contact of the tapping pipe by metal melt being tapped through said tapping pipe;

c) an induction means at the tapping pipe; and d) at least three power terminals at said induction means for connection to an alternating current power source, whereby an induction current can be applied to a variable portion of the induction means, whereby said induction means can apply an induction current to heat at least a portion of the tapping pipe to a temperature that is higher than that of said bath metal within said tapping pipe and thereby melt said solidified bath metal within said tapping pipe to tap the molten metal bath from the reactor.

47. An apparatus for tapping a molten metal bath from a reactor, comprising:

a) a tapping pipe, having a tapping pipe inlet and a tapping pipe outlet, said tapping pipe being attachable at said tapping pipe inlet to a reactor, and said tapping pipe including a susceptor, whereby said tapping pipe can be heated by an induction current to a higher temperature than that of a solidified bath metal within said tapping pipe;

b) a ceramic insert that lines the tapping pipe to substantially prevent contact of the tapping pipe by metal melt being tapped through said tapping pipe;

c) an induction means at the tapping pipe, wherein said induction means can apply an induction current to the susceptor to heat the tapping pipe to a temperature that is higher than that of said bath metal within said tapping pipe and thereby melt said solidified bath metal to tap the molten metal bath from the reactor; and d) a slidable gate valve assembly at said tapping pipe outlet.

48. An apparatus for tapping a molten metal bath from a reactor, comprising:

a) a tapping pipe, having a tapping pipe inlet and a tapping pipe outlet, said tapping pipe being attachable at said tapping pipe inlet to a reactor, and said tapping pipe including a susceptor, whereby said tapping pipe can be heated by an induction current to a higher temperature than that of a solidified bath metal within said tapping pipe;

b) a ceramic insert that lines the tapping pipe to substantially prevent contact of the tapping pipe by metal melt being tapped through said tapping pipe;

c) an induction means at the tapping pipe, wherein said induction means can apply an induction current to the susceptor to heat the tapping pipe to a temperature that is higher than that of said bath metal within said tapping pipe and thereby melt said solidified bath metal to tap the molten metal bath from the reactor;

d) a sleeve annularly disposed about said induction coil;

e) a flange at one end of said sleeve and proximate to said tapping pipe outlet, said flange defining an orifice at said tapping pipe outlet; and f) at least one insert at said orifice, said insert having a melting point below that of said flange.

49. An apparatus for tapping a molten metal bath from a reactor, comprising:

a) a tapping pipe, having a tapping pipe inlet and a tapping pipe outlet, said tapping pipe being attached and at an incline extending from a reactor at said tapping pipe inlet to the reactor, and said tapping pipe including a susceptor, whereby said tapping pipe can be heated by an induction current to a higher temperature than that of a solidified bath metal within said tapping pipe;

b) a ceramic insert that lines the tapping pipe to substantially prevent contact of the tapping pipe by metal melt being tapped through said tapping pipe; and c) an induction means at the tapping pipe, wherein said induction means can apply an induction current to the susceptor to heat the tapping pipe to a temperature that is higher than that of said bath metal within said tapping pipe and thereby melt said solidified bath metal to tap the molten metal bath from the reactor.

50. A method for tapping a molten metal bath from a reactor, comprising the steps of:

a) applying an induction current to a susceptor of a tapping pipe, whereby said tapping pipe is heated by an induction current to a higher temperature than that of a solidified bath metal component within said tapping pipe having a ceramic insert that lines the tapping pipe to substantially prevent contact of the tapping pipe by metal melt being tapped through said tapping pipe, said solidified bath metal component melting in the tapping pipe; and b) tapping at least a portion of the molten metal bath from the reactor.

51. The method of claim 50 further including the step of cooling said tapping pipe sufficiently to cause molten metal within the tapping pipe to solidify within said tapping pipe, thereby controlling tapping of the molten bath.

* * * * *